US008405589B2

(12) United States Patent
Ding

(10) Patent No.: US 8,405,589 B2
(45) Date of Patent: Mar. 26, 2013

(54) LIQUID CRYSTAL DISPLAY DATA PROCESSING METHOD AND APPARATUS

(75) Inventor: Yue Ding, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 1017 days.

(21) Appl. No.: 12/422,339

(22) Filed: Apr. 13, 2009

(65) Prior Publication Data

US 2009/0256788 A1 Oct. 15, 2009

(30) Foreign Application Priority Data

Apr. 14, 2008 (CN) ..... 2008 1 0104045

(51) Int. Cl.
*G09G 3/36* (2006.01)

(52) U.S. Cl. ..... 345/87; 345/103; 345/55; 345/50

(58) Field of Classification Search ..... None
See application file for complete search history.

(56) References Cited

U.S. PATENT DOCUMENTS

2001/0040564 A1 11/2001 Yun et al.
2007/0061660 A1* 3/2007 Konishi et al. ..... 714/746

FOREIGN PATENT DOCUMENTS

CN 1856818 A 11/2006

* cited by examiner

*Primary Examiner* — Muhammad N Edun
(74) *Attorney, Agent, or Firm* — Ladas & Parry LLP

(57) ABSTRACT

The present invention relates to a Liquid Crystal Display data processing method and apparatus. The data processing method comprises receiving a $(n+1)^{th}$ row of actual data, reading a buffered $n^{th}$ row of actual data, and performing an exclusive-or operation on the $(n+1)^{th}$ row of actual data and the $n^{th}$ row of actual data to generate a $(n+1)^{th}$ row of exclusive-or data and transmit it to a data driver. The data processing apparatus comprises a signal receiver, a data path, a first data receiver, a first data buffer memory, an exclusive-or processor and a data transmitter, wherein the exclusive-or processor is connected to the first data receiver and the first data buffer memory respectively, and is used to generate a current row of exclusive-or data by performing an exclusive-or operation. The present invention removes redundant data, effectively reduces data variation amount in data transmission between a sequential controller and the data driver, and reduces Electro-Magnetic Interference of the Liquid Crystal Display to the largest extent.

16 Claims, 7 Drawing Sheets

LIQUID CRYSTAL DISPLAY DATA PROCESSING METHOD AND APPARATUS

FIELD OF THE INVENTION

The present invention relates to a data processing apparatus and method, and in particular relates to a Liquid Crystal Display data processing method and apparatus.

DESCRIPTION OF RELATED ART

At present, Thin Film Transistor Liquid Crystal Display has been largely popularized and has become a mainstream product, since it has characteristics of small volume, low power consumption, no radiation, high display resolution, etc.

While TFT-LCD is working, a sequential controller receives signals transmitted by an external device, and converts them to digital signals which are suitable to be received by a data driver; the data driver converts the received digital signals to analog signals, and then progressively loads the analog signals to a Liquid Crystal Display panel in manner of progressive scan. FIG. 9 is a structural schematic diagram of a prior art sequential controller, which comprises sequentially connected signal receiver 11, data path 12, row data buffer memory 13, and data transmitter 14. The signal receiver 11 is used to receive input signals transmitted by an external device, which are commonly Low Voltage Differential Signaling (LVDS) or Reduced Swing Differential Signaling (RSDS). The input signals are combined by the data path 12 to form one aligned row of data, and the one row of data is stored in the row data buffer memory 13 and is transmitted to the data driver by the data transmitter 14 after a row data transmission start signal transmitted by the data driver is received. FIG. 10 is a structural schematic diagram of a prior art data driver, which comprises sequentially connected row data buffer memory 22, digital to analog converter 23 and output circuit 24. The data driver transmits a row start signal to the sequential controller, the sequential controller transmits one row of data to the data driver, and the one row of data transmitted by the sequential controller is received and buffered by the row data buffer memory 22, and is output by the output circuit 24 after it is converted by the digital to analog converter 23. After finishing receiving the one row of data, the data driver will transmit the row start signal again, and the sequential controller will transmit next one row of data to the data driver. In accordance with this method, the sequential controller transmits one frame of display data completely to the data driver, and thus, data transmission amount of such data transmission in the prior art is very large, and transmission frequency of data within unit time of such data transmission is very high.

Table 1 is a table of data transmission between the sequential controller and the data driver according to prior art. For the sake of convenient explanation, it is assumed that the data is N rows, each row is one display data of a 6-bit sub-pixel in binary representation, which directly corresponds to a grey scale voltage to be output. A first row of data is assumed as 010101, and thus while transmitting this row of data, the transmitted data varies from logic low to logic high or from logic high to logic low for 5 times in total, i.e., data variation amount is 5. A second row of data is also assumed as 010101, and thus while transmitting this row of data, the transmitted data varies from logic low to logic high or from logic high to logic low for 5 times in total, i.e., data variation amount is also 5. Although the two rows of data are completely identical, the data transmitted from the sequential controller to the data driver still varies for 5 times. When a third row of data varies to 100101, the data variation amount is 4. Thus it can be seen that in the data transmission between the sequential controller and the data driver according to the prior art, the data variation amount only relates to data transmitted in the current row, and even if data in respective adjacent rows is identical, the data variation amount in the data transmission does not vary.

TABLE 1 table for conditions of the data transmission between the sequential controller and the data driver according to the prior art

| Rows | Data | | | | | | Data variation amount |
|---|---|---|---|---|---|---|---|
| First row | 0 | 1 | 0 | 1 | 0 | 1 | 5 |
| Second row | 0 | 1 | 0 | 1 | 0 | 1 | 5 |
| Third row | 1 | 0 | 0 | 1 | 0 | 1 | 4 |
| Fourth row | 0 | 1 | 0 | 1 | 0 | 1 | 5 |
| --- | --- | --- | --- | --- | --- | --- | --- |
| $N^{th}$ row | 0 | 1 | 0 | 1 | 0 | 1 | 5 |
| $(N+1)^{th}$ row | 0 | 1 | 0 | 1 | 0 | 1 | 5 |

With respect to high resolution and high color Liquid Crystal Display, data transmission amount between the sequential controller and the data driver is greater, and data variation amount during transmission is greater. Since data variations (rising edge variations or falling edge variations) during data transmission would result in Electro-Magnetic Interference (EMI), such large data transmission amount and high transmission frequency in the prior art affects picture quality of the Liquid Crystal Display to some extent. At present, the Electro-Magnetic Interference problem of the Liquid Crystal Display has already become a technical puzzle in field of Liquid Crystal driving.

SUMMARY OF THE INVENTION

The present invention provides a Liquid Crystal Display data processing method and apparatus, which effectively reduces Electro-Magnetic Interference of the Liquid Crystal Display by removing redundant data and reducing data variation amount during transmission.

A first aspect of the present invention provides a Liquid Crystal Display data processing method, comprising:

step 11 of receiving a $(n+1)^{th}$ row of actual data;

step 12 of reading a buffered $n^{th}$ row of actual data; and step 13 of performing an exclusive-or operation on the $(n+1)^{th}$ row of actual data and the $n^{th}$ row of actual data to generate a $(n+1)^{th}$ row of exclusive-or data and transmit it to a data driver.

The first aspect of the present invention also provides a Liquid Crystal Display data processing apparatus, comprising:

a signal receiver for receiving input signals transmitted by an external device;

a data path connected to the signal receiver, for combining the input signals to form one aligned row of data;

a first data receiver connected to the data path, for receiving a current row of actual data transmitted by the data path at a current time, a first data buffer memory for buffering a previous row of actual data;

an exclusive-or processor connected to the first data receiver and the first data buffer memory respectively, for performing an exclusive-or operation on the current row of actual data and the previous row of actual data to generate a current row of exclusive-or data; and a data transmitter connected to the exclusive-or processor, for transmitting the current row of exclusive-or data to the data driver.

A second aspect of the present invention provides a Liquid Crystal Display data processing method, comprising:

step 21 of receiving a $(n+1)^{th}$ row of exclusive-or data from a sequential controller;

step 22 of reading a buffered $n^{th}$ row of actual data; and step 23 of performing an exclusive-or operation on the $(n+1)^{th}$ row of exclusive-or data and the $n^{th}$ row of actual data to restore a $(n+1)^{th}$ row of actual data and output it to a Liquid Crystal Display panel.

The second aspect of the present invention also provides a Liquid Crystal Display data processing apparatus, comprising:

a second data receiver connected to a sequential controller, for receiving a current row of exclusive-or data from the sequential controller;

a second data buffer memory, for buffering a previous row of actual data;

an exclusive-or restorer connected to the second data receiver and the second data buffer memory respectively, for performing an exclusive-or operation on the current row of exclusive-or data and the previous row of actual data to restore a current row of actual data;

a digital to analog converter connected to the exclusive-or restorer, for performing a digital to analog conversion on the current row of actual data; and an output circuit connected to the digital to analog converter, for outputting the current row of actual data to a Liquid Crystal Display panel.

A third aspect of the present invention provides a Liquid Crystal Display data processing method, comprising:

step 31 of receiving a $(n+1)^{th}$ row of actual data;

step 32 of reading a buffered $n^{th}$ row of actual data;

step 33 of performing an exclusive-or operation on the $(n+1)^{th}$ row of actual data and the $n^{th}$ row of actual data to generate a $(n+1)^{th}$ row of exclusive-or data and transmit it to a data driver;

step 34 of receiving the $(n+1)^{th}$ row of exclusive-or data;

step 35 of reading the buffered n row of actual data; and step 36 of performing an exclusive-or operation for the $(n+1)^{th}$ row of exclusive-or data and the $n^{th}$ row of actual data to restore a $(n+1)^{th}$ row of actual data and output it to a Liquid Crystal Display panel.

The third aspect of the present invention also provides a Liquid Crystal Display data processing apparatus, comprising:

a signal receiver for receiving input signals transmitted by an external device;

a data path connected to the signal receiver, for combining the input signals to form one aligned row of data;

a first data receiver connected to the data path, for receiving a current row of actual data transmitted by the data path at a current time;

a first data buffer memory for buffering a previous row of actual data;

an exclusive-or processor connected to the first data receiver and the first data buffer memory respectively, for performing an exclusive-or operation on the current row of actual data and the previous row of actual data to generate a current row of exclusive-or data;

a data transmitter connected to the exclusive-or processor, for transmitting the current row of exclusive-or data;

a second data receiver connected to said data transmitter, for receiving a current row of exclusive-or data from the sequential controller;

a second data buffer memory, for buffering a previous row of actual data;

an exclusive-or restorer connected to the second data receiver and the second data buffer memory respectively, for performing an exclusive-or operation on the current row of exclusive-or data and the previous row of actual data to restore a current row of actual data;

a digital to analog converter connected to the exclusive-or restorer, for performing a digital to analog conversion on the current row of actual data; and an output circuit connected to the digital to analog converter, for outputting the current row of actual data to a Liquid Crystal Display panel.

The present invention proposes a Liquid Crystal Display data processing method and apparatus, wherein an exclusive-or operation is performed on a previous row (frame) of data and a current row (frame) of data and exclusive-or data is transmitted to a data driver before a sequential transmits the current row (frame) of data to the data driver. After receiving the data, the data driver performs the exclusive-or operation on the exclusive-or data again, so to restore the current row (frame) of data into actual data and then output it. The Liquid Crystal Display data processing method and apparatus of the present invention remove redundant data, effectively reduce data variation amount in data transmission between the sequential controller and the data driver, and reduce Electro-Magnetic Interference (EMI) of the Liquid Crystal Display to the largest extent.

Hereinafter, a technical solution of the present invention is further described in details through accompanying drawings and embodiments.

ILLUSTRATIONS FOR REFERENCE SIGNS

11—signal receiver; 12—data path; 13*a*—first data receiver; 13*b*—first data buffer memory; 14—data transmitter; 15—exclusive-or processor; 22*a*—second data receiver; 22*b*—second data buffer memory; 23—digital to analog converter; 24—output circuit; 25—exclusive-or restorer; 151—first collecting module; 152—second collecting module; 153—exclusive-or processing module; 154—exclusive-or data transmitting module; 251—third collecting module; 252—fourth collecting module; 253—exclusive-or restoring module; 254—actual data transmitting module.

DETAILED DESCRIPTION OF THE INVENTION

Through deep research, the inventor finds that in actual use more than 90% data of two adjacent rows in data transmitted between a sequential controller and a data driver is identical, especially when displaying graphic interface windows. Even if displayed pictures are different between rows, the difference therebetween is very small in most cases. Identical displayed pictures mean identical transmitted data, i.e., most of the data transmitted to the data driver by the sequential controller is iterative, which is referred as redundant data in the present invention. While a large amount of redundant data exists between rows, sometimes a whole frame of data is redundant data as for static pictures since the pictures do not vary or varies a little for a long time.

Figure 1:
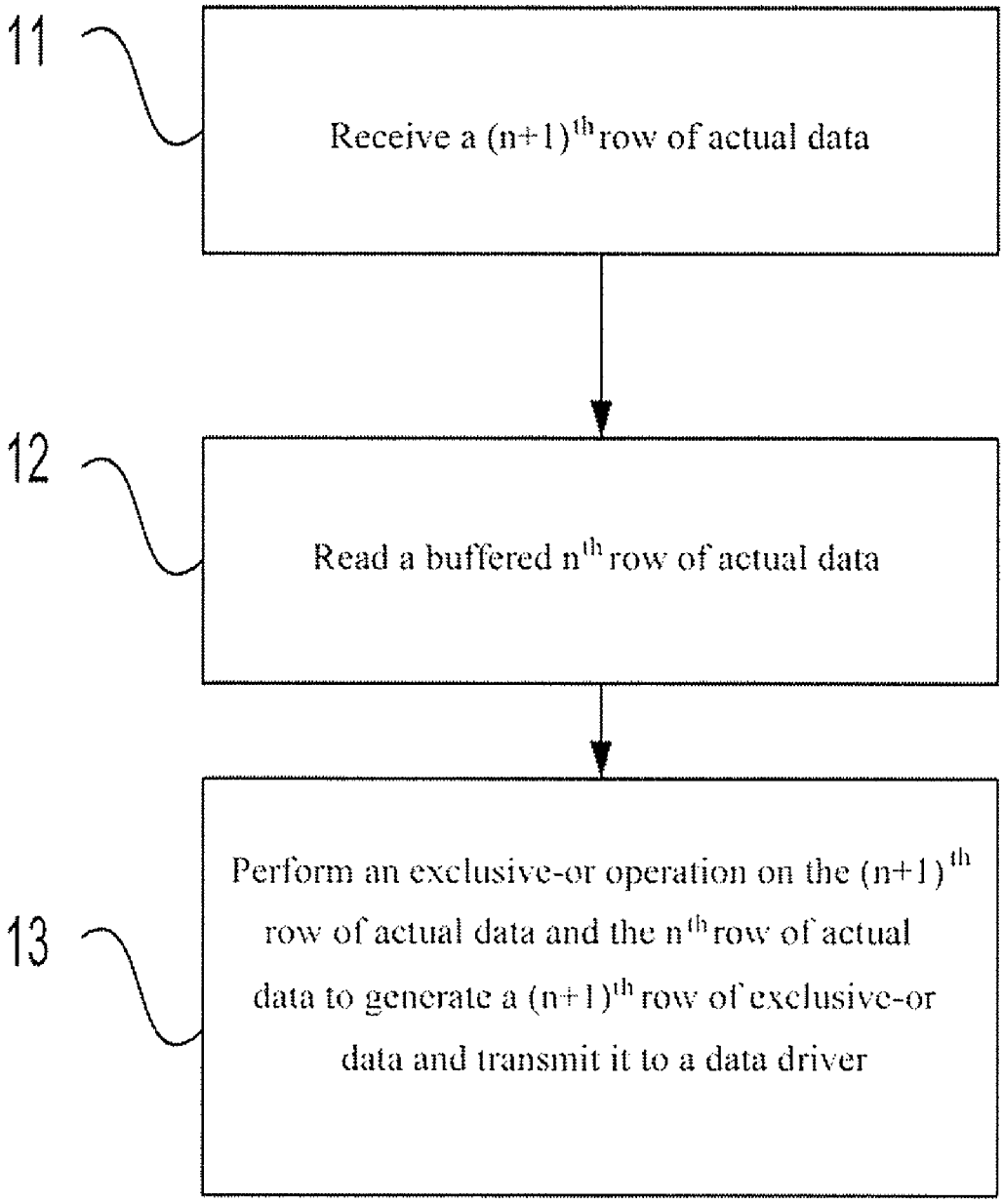
FIG. 1 is a flow diagram of a first scheme of the Liquid Crystal Display data processing method of the present invention.

FIG. 1 is a flow diagram of the first scheme of the Liquid Crystal Display data processing method of the present invention, and the first scheme particularly is:

step 11 of receiving a $(n+1)^{th}$ row of actual data;

step 12 of reading a buffered $n^{th}$ row of actual data; and step 13 of performing an exclusive-or operation on the $(n+1)^{th}$ row of actual data and the $n^{th}$ row of actual data to generate a $(n+1)^{th}$ row of exclusive-or data and transmit it to the data driver, wherein the step 13 particularly is: performing the exclusive-or operation on the $(n+1)^{th}$ row of actual data and the $n^{th}$ row of actual data, letting an exclusive-or result of a $m^{th}$ term in the $(n+1)^{th}$ row of exclusive-or data be 0 when the data of a $m^{th}$ term in the $(n+1)^{th}$ row of actual data and the data of a $m^{th}$ term in the $n^{th}$ row of actual data is identical, letting an exclusive-or result of the $m^{th}$ term in the $(n+1)^{th}$ row of exclusive-or data be 1 when the data of the $m^{th}$ term in the $(n+1)^{th}$ row of actual data and the data of the $m^{th}$ term in the $n^{th}$ row of actual data is not identical, and generating the $(n+1)^{th}$ row of exclusive-or data and transmitting it to the data driver, wherein m=1~M, n=1~N. M is the number of bits in each row of sub-pixels display data of a Liquid Crystal Display panel, and N is the number of rows of the sub-pixels of the Liquid Crystal Display panel. Thus, the $(n+1)^{th}$ row of exclusive-or data composed by M terms of exclusive-or results can be obtained through the exclusive-or operation.

Table 2 is a table displaying conditions of data processed by the Liquid Crystal Display data processing method of the present invention, in which transmitted data is completely identical with that shown in Table 1 for the sake of convenient comparison. A first row of data is 010101, and a second row of data is identical with the first row of data. The first row of data is normally transmitted, and data variation amount in the data transmission is 5. Before transmitting the second row of data, the present invention performs an operation on the second row of data and the first row of data in manner of exclusive-or operation, wherein when data of the corresponding terms in the first row of data and the second row of data is identical, i.e. both of data of the corresponding terms is 0 or 1, an exclusive-or result of said term is 0, and when data of the corresponding terms in the first row of data and the second row of data is not identical i.e., one of them is 1 and the other one is 0, the exclusive-or result of said term is 1. Since the first row of data is identical with the second row of data in the present embodiment, a second row of exclusive-or data obtained after the exclusive-or operation is 000000, and the data variation amount in the data transmission is 0. Before transmitting a third row of data, the present invention performs an operation on the third row of data and the second row of data in manner of the exclusive-or operation. Since first two bits of the third row of data and the second row of data are not identical and last four bits of them are identical, a third row of exclusive-or data obtained after the exclusive-or operation is 110000 and the data variation amount in the data transmission is 1, and the rest follows in the same manner.

It can be seen from the above-mentioned embodiment, as compared to the data variation amount in the data transmission of the prior art as shown in Table 1, the data variation amount in the data transmission of the present invention is greatly reduced. Although this is only limited to cases in which data between the rows is identical or varies a little, such cases accounts for more than 90% in practical applications. Further, the above-mentioned technical solution of the present invention is also applicable to process between frames. The present invention effectively reduces transmission of redundant data through such data reducing method, and reduces Electro-Magnetic Interference (EMI) of the Liquid Crystal Display to the largest extent by reducing the data variation amount in the data transmission between the sequential controller and the data driver.

TABLE 2 table for conditions of data processed by the Liquid Crystal Display data processing method of the present invention

| Rows | Original data | | | | | | | Exclusive-or data | | | | | | Data variation amount |
|---|---|---|---|---|---|---|---|---|---|---|---|---|---|---|
| First row | 0 | 1 | 0 | 1 | 0 | 1 | ⇨ | 0 | 1 | 0 | 1 | 0 | 1 | 5 |
| Second row | 0 | 1 | 0 | 1 | 0 | 1 | ⇨ | 0 | 0 | 0 | 0 | 0 | 0 | 0 |
| Third row | 1 | 0 | 0 | 1 | 0 | 1 | ⇨ | 1 | 1 | 0 | 0 | 0 | 0 | 1 |
| Fourth row | 0 | 1 | 0 | 1 | 0 | 1 | ⇨ | 1 | 1 | 0 | 0 | 0 | 0 | 1 |
| --- | --- | --- | --- | --- | --- | --- | --- | --- | --- | --- | --- | --- | --- | --- |
| $N^{th}$ row | 0 | 1 | 0 | 1 | 0 | 1 | ⇨ | 0 | 0 | 0 | 0 | 0 | 0 | 0 |
| $(N+1)^{th}$ row | 0 | 1 | 0 | 1 | 0 | 1 | ⇨ | 0 | 0 | 0 | 0 | 0 | 0 | 0 |

In the step 13 of the above-mentioned technical solution, it is one aforehand setting that letting the exclusive-or result be 0 when the data is identical and letting the exclusive-or result be 1 when the data is not identical, and it can be designed in the practical use as the exclusive-or result being 1 when the data is identical and the exclusive-or result being 0 when the data is not identical, which also results in same effects.

Figure 2:
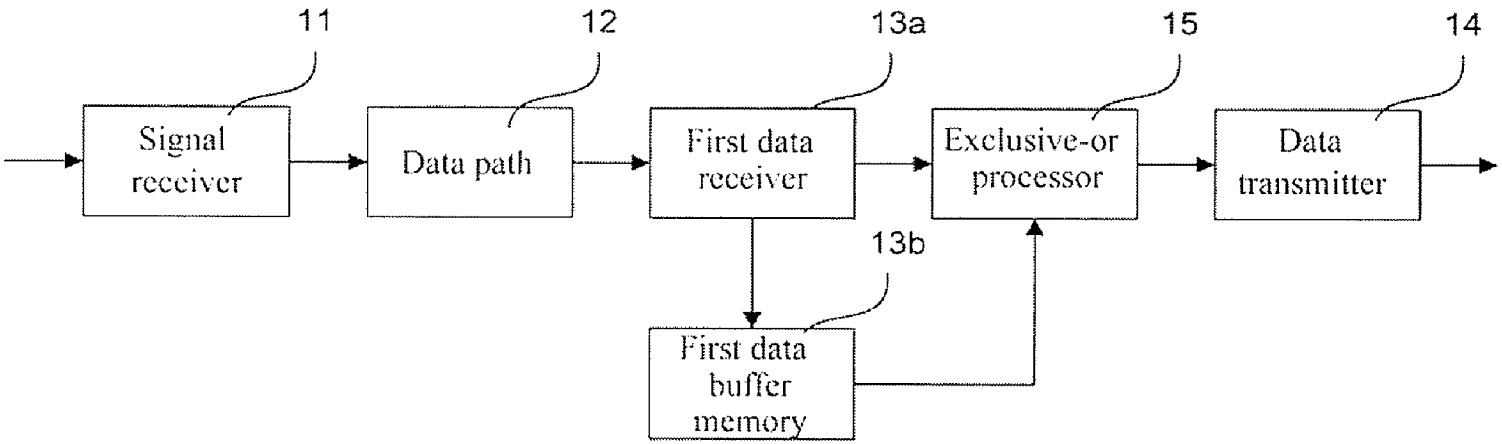
FIG. 2 is a structural diagram of a first scheme of the Liquid Crystal Display data processing apparatus of the present invention.

FIG. 2 is a structural diagram of the first scheme of the Liquid Crystal Display data processing apparatus of the present invention, which is an implementation apparatus adopting the first scheme of the Liquid Crystal Display data processing method of the present invention as shown in FIG. 1. The data processing apparatus of the present scheme comprises sequentially connected signal receiver 11, data path 12, first data receiver 13*a*, exclusive-or processor 15 and data transmitter 14, and also comprises a first data buffer memory 13*b* which is connected to the first data receiver 13*a* and the exclusive-or processor 15 respectively.

Particularly, the signal receiver 11 is connected to an external device, for receiving input signals transmitted by the external device; the data path 12 is connected to the signal receiver 11, for combining the input signals to form one aligned row of data; the first data receiver 13*a* is connected to the data path 12, for receiving a current row of actual data from the data path 12; the first data buffer memory 13*b* is connected to the first data receiver 13*a*, for buffering a previous row of actual data previously received by the first data receiver 13*a*; the exclusive-or processor 15 is connected to the first data receiver 13*a* and the first data buffer memory 13*b* respectively, for collecting the current row of actual data from the first data receiver 13*a*, collecting the previous row of actual data from the first data buffer memory 13*b*, comparing the current row of actual data with the previous row of actual data in manner of exclusive-or operation to generate a current row of exclusive-or data; and the data transmitter 14 is connected to the exclusive-or processor 15, for receiving the current row of exclusive-or data transmitted by the exclusive-or processor 15 and transmitting the current row of exclusive-or data to the data driver after receiving a row data transmission start signal transmitted by the data driver. In the present scheme, the input signals are commonly Low Voltage Differential Signaling (LVDS) or Reduced Swing Differential Signaling (RSDS).

Figure 3:
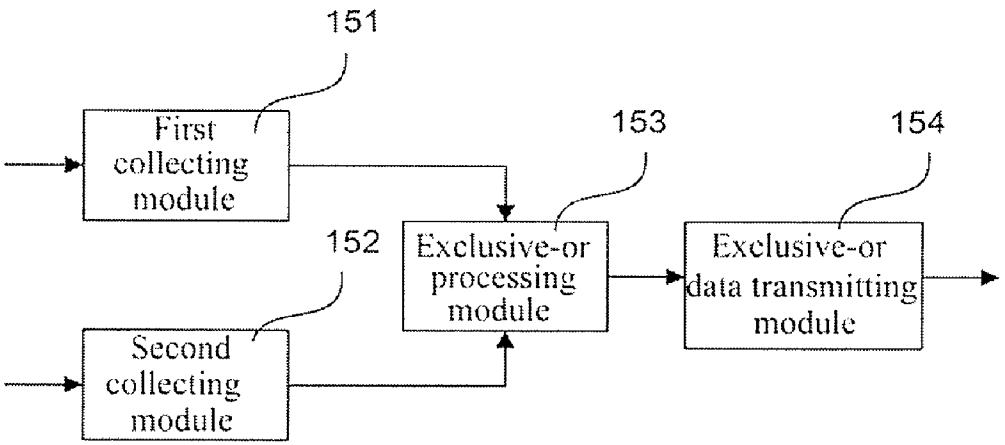
FIG. 3 is a structural diagram of an exclusive-or processor in the first scheme of the Liquid Crystal Display data processing apparatus of the present invention.

FIG. 3 is a structural diagram of an exclusive-or processor in the first scheme of the Liquid Crystal Display data processing apparatus of the present invention. The exclusive-or processor 15 comprises first collecting module 151, second collecting module 152, exclusive-or processing module 153 and exclusive-or data transmitting module 154. The first collecting module 151 is connected to the first data receiver 13*a*, for collecting the current row of actual data from the first data receiver 13*a*; the second collecting module 152 is connected to the first data buffer memory 13*b*, for collecting the previous row of actual data from the first data buffer memory 13*b*; the exclusive-or processing module 153 is connected to the first collecting module 151 and the second collecting module 152 respectively, for performing an operation on the current row of actual data and the previous row of actual data in manner of exclusive-or operation to obtain the current row of exclusive-or data composed by exclusive-or results, wherein an exclusive-or result of an item in the current row of exclusive-or data is 0 when data of corresponding terms in the current row of actual data and the previous row of actual data is identical, and the exclusive-or result of the item in the current row of exclusive-or data is 1 when data of corresponding terms in the current row of actual data and the previous row of actual data is not identical; the exclusive-or data transmitting module 154 is connected to the exclusive-or processing module 153, for transmitting the current row of exclusive-or data obtained by the exclusive-or processing module 153. The manner of exclusive-or operation adopted by the exclusive-or processing module 153 can be referred to the embodiment shown in Table 2, and we will not go further on this issue herein.

Figure 4:
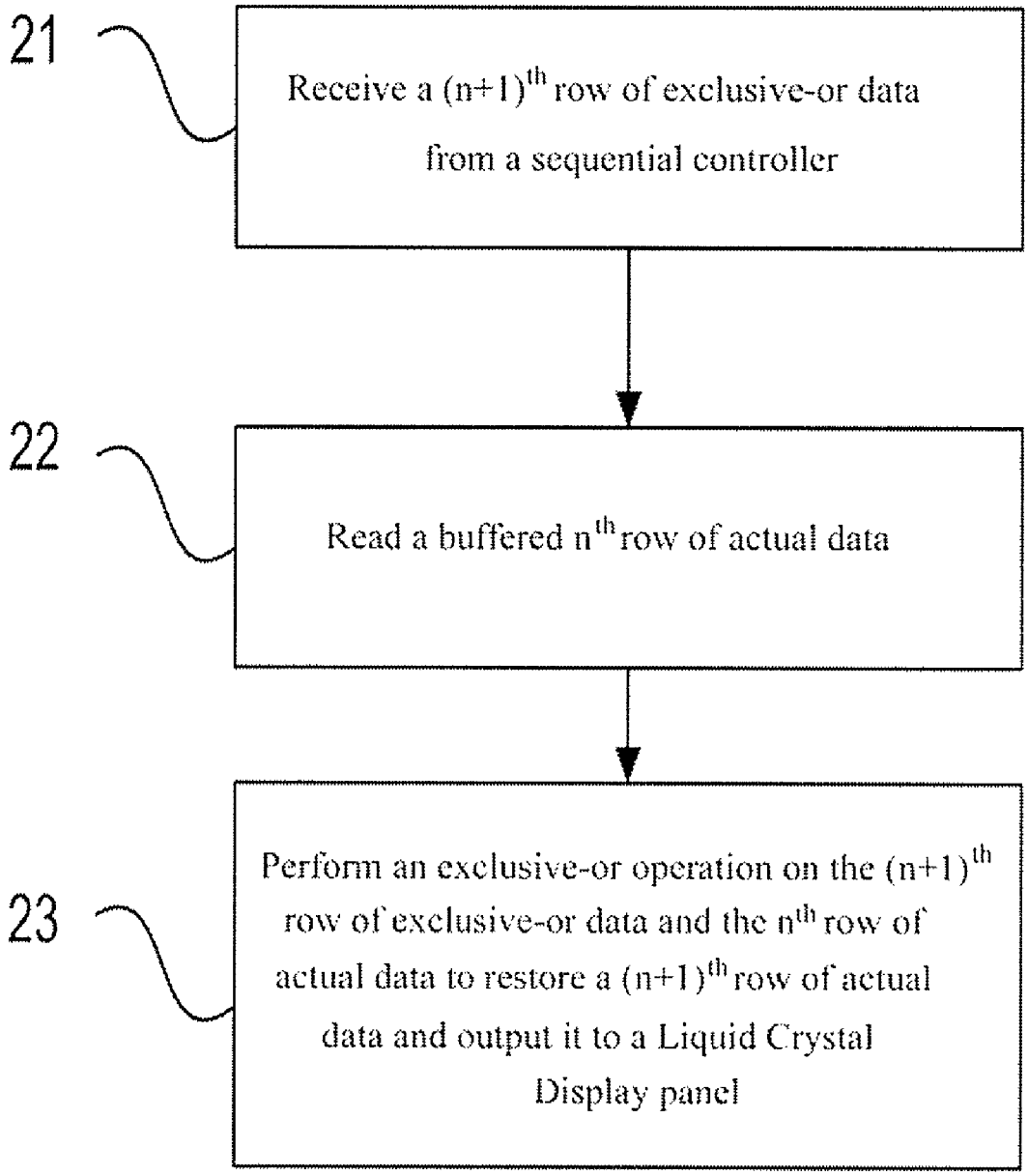
FIG. 4 is a flow diagram of a second scheme of the Liquid Crystal Display data processing method of the present invention.

FIG. 4 is a flow diagram of a second scheme of the Liquid Crystal Display data processing method of the present invention, and the second scheme particularly is:

step 21 of receiving a $(n+1)^{th}$ row of exclusive-or data from a sequential controller;

step 22 of reading a buffered $n^{th}$ row of actual data; and step 23 of performing an exclusive-or operation on the $(n+1)^{th}$ row of exclusive-or data and the $n^{th}$ row of actual data to restore a $(n+1)^{th}$ row of actual data and output it to a Liquid Crystal Display panel.

wherein the step 23 particularly is: performing the exclusive-or operation on the $(n+1)^{th}$ row of exclusive-or data and the $n^{th}$ row of actual data, that is to say, when the $m^{th}$ term in the $(n+1)^{th}$ row of exclusive-or data is 0, which indicates the data of the $m^{th}$ term in the $(n+1)^{th}$ row of actual data is identical with the data of the $m^{th}$ term in the $n^{th}$ row of actual data, letting data of a $m^{th}$ term in the $(n+1)^{th}$ row of actual data be equal to data of a $m^{th}$ term in the $n^{th}$ row of actual data; and when the $m^{th}$ term in the $(n+1)^{th}$ row of exclusive-or data is 1, which indicates the data of the $m^{th}$ term in the $(n+1)^{th}$ row of actual data is not identical with the data of the $m^{th}$ term in the $n^{th}$ row of actual data, letting the data of the $m^{th}$ term in the $(n+1)^{th}$ row of actual data be equal to an absolute value of the data of the $m^{th}$ term in the $n^{th}$ row of actual data minus 1, wherein m=1~M, n=1~N, M is the number of bits in each row of sub-pixels display data of a Liquid Crystal Display panel, and N is the number of rows of the sub-pixels of the Liquid Crystal Display panel. Thus, the $(n+1)^{th}$ row of actual data composed by M terms of data can be obtained through the exclusive-or operation.

Table 3 illustrates conditions of data restored by the Liquid Crystal Display data processing method of the present invention, in which transmitted data is completely identical with that shown in Table 1 for the sake of convenient comparison. A first row of exclusive-or data is normally received, and the data remains unvaried, i.e., the first row of data is 010101. After receiving a second row of exclusive-or data, the present invention performs an operation on the received second row of exclusive-or data and the actual first row of data in manner of exclusive-or operation, wherein a certain term in the second row of exclusive-or data being 0 indicates data of corresponding terms of the actual second row of data and the first row of data is identical, i.e., both of the data is 0 or both of the data is 1; and the certain term in the second row of exclusive-or data being 1 indicates data of corresponding terms of the actual second row of data and first row of data is not identical, i.e., the corresponding term of the second row of data being 0 if the corresponding term of the first row of data is 1, and the corresponding term of the second row of data being 1 if the corresponding term of the first row of data is 0. Since the second row of exclusive-or data in the present embodiment is 000000, it is indicated that the actual second row of data is identical with the first row of data, i.e., the second row of data obtained after the exclusive-or operation is also 010101. After receiving a third row of exclusive-or data, the present invention performs an operation on the third row of exclusive-or data and the actual second row of data in manner of exclusive-or operation. Since the third row of exclusive-or data is 110000, it is indicated that the first two bits of the actual third row of data and the second row of data are not identical and last four bits of them are identical, the third row of data obtained after the exclusive-or operation is 100101, and the rest follows in the same manner.

It can be seen from the above-mentioned embodiment, by performing the exclusive-or operation to restore the actual row data, the present invention ensures normal operations of the Liquid Crystal Display, while effectively reducing transmission of redundant data, reducing data variation amount in transmission, and reducing Electro-Magnetic Interference of the Liquid Crystal Display to the largest extent.

TABLE 3 conditions of data restored by the Liquid Crystal Display data processing method of the present invention

| Rows | Exclusive-or data | | | | | | | Actual data | | | | | |
|---|---|---|---|---|---|---|---|---|---|---|---|---|---|
| First row | 0 | 1 | 0 | 1 | 0 | 1 | ⇨ | 0 | 1 | 0 | 1 | 0 | 1 |
| Second row | 0 | 0 | 0 | 0 | 0 | 0 | ⇨ | 0 | 1 | 0 | 1 | 0 | 1 |
| Third row | 1 | 1 | 0 | 0 | 0 | 0 | ⇨ | 1 | 0 | 0 | 1 | 0 | 1 |
| Fourth row | 1 | 1 | 0 | 0 | 0 | 0 | ⇨ | 0 | 1 | 0 | 1 | 0 | 1 |
| --- | --- | --- | --- | --- | --- | --- | --- | --- | --- | --- | --- | --- | --- |
| $N^{th}$ row | 0 | 0 | 0 | 0 | 0 | 0 | ⇨ | 0 | 1 | 0 | 1 | 0 | 1 |
| $(N+1)^{th}$ row | 0 | 0 | 0 | 0 | 0 | 0 | ⇨ | 0 | 1 | 0 | 1 | 0 | 1 |

In the step 23 of the above-mentioned technical solution, it is one aforehand setting that letting the data be identical when the exclusive-or data is 0 and letting the data be not identical when the exclusive-or data is 1, and it can also be set according to different processes from the above process as letting the data be identical when the exclusive-or data is 1 and letting the data be not identical when the exclusive-or data is 0, which also results in same effects.

Figure 5:
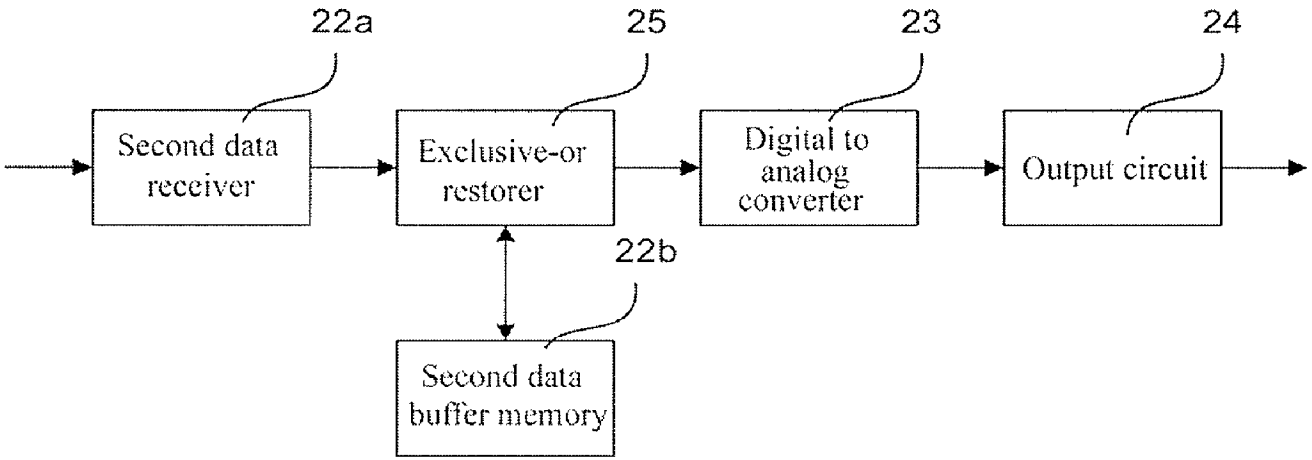
FIG. 5 is a structural diagram of a second scheme of a Liquid Crystal Display data processing apparatus of the present invention.

FIG. 5 is a structural diagram of the second scheme of a Liquid Crystal Display data processing apparatus of the present invention, which is an implementation apparatus adopting the second scheme of the Liquid Crystal Display data processing method of the present invention as shown in FIG. 4. The data processing apparatus of the present scheme comprises sequentially connected second data receiver 22*a*, exclusive-or restorer 25, digital to analog converter 23, and output circuit 24, wherein the exclusive-or restorer 25 is also connected to second data buffer memory 22*b*.

Particularly, the second data receiver 22*a* is connected to a sequential controller, for receiving a current row of exclusive-or data from the sequential controller; the exclusive-or restorer 25 is connected to the second data receiver 22*a* and the second data buffer memory 22*b* respectively, for collecting the current row of exclusive-or data from the second data receiver 22*a*, collecting a previous row of actual data from the second data buffer memory 22*b*, performing an exclusive-or operation on the current row of exclusive-or data and the previous row of actual data, so to generate a current row of actual data, and transmitting the current row of actual data to the second data buffer memory 22*b* for buffering; the digital to analog converter 23 is connected to the exclusive-or restorer 25, for performing digital to analog conversion on the current row of actual data transmitted by the exclusive-or restorer 25; the output circuit 24 is connected to the digital to analog converter 23, for loading the converted current row of actual data to a Liquid Crystal Display panel in manner of progressive scan.

Figure 6:
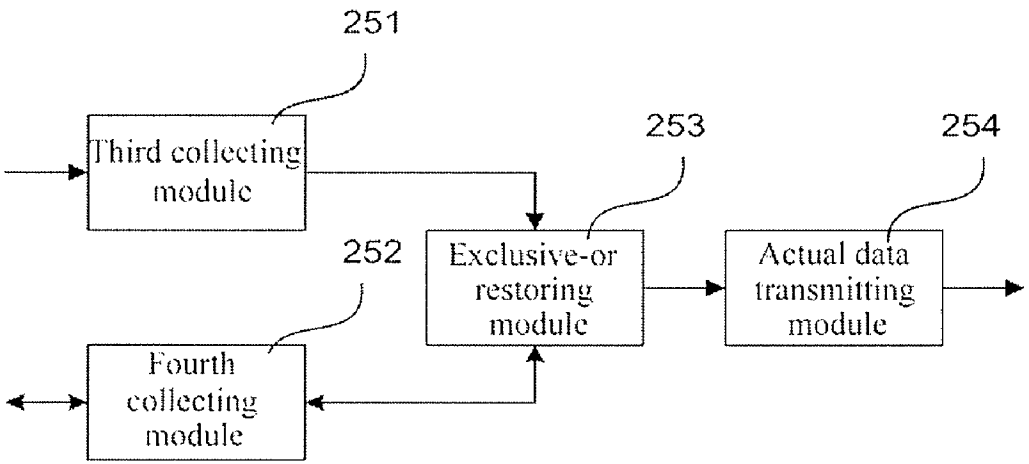
FIG. 6 is a structural diagram of an exclusive-or restorer in the second scheme of the Liquid Crystal Display data processing apparatus of the present invention.

FIG. 6 is a structural diagram of an exclusive-or restorer in the second scheme of the Liquid Crystal Display data processing apparatus of the present invention. The exclusive-or restorer 25 comprises third collecting module 251, fourth collecting module 252, exclusive-or restoring module 253, and actual data transmitting module 254. The third collecting module 251 is connected to the second data receiver 22*a*, for collecting the current row of exclusive-or data from the second data receiver 22*a*; the fourth collecting module 252 is connected to the second data buffer memory 22*b*, for collecting the previous row of actual data from the second data buffer memory 22*b*; the exclusive-or restoring module 253 is connected to the third collecting module 251 and the fourth collecting module 252 respectively, for obtaining the current row of exclusive-or data from the third collecting module 251, obtaining the previous row of actual data from the fourth collecting module 252, performing the exclusive-or operation on the current row of exclusive-or data and the previous row of actual data, wherein when a certain term in current row of exclusive-or data is 0, which indicates data of corresponding terms in the current row of actual data and the previous row of actual data is identical, letting data of the certain term in the current row of actual data be equal to data of the certain term in the previous row of actual data, and when the certain term in current row of exclusive-or data is 1, which indicates data of corresponding terms in the current row of actual data and the previous row of actual data is not identical, letting the data of the certain term in the current row of actual data be equal to an absolute value of the data of the certain term in the previous row of actual data minus 1, therefore the current row of actual data composed by the data of the corresponding terms can be obtained; after obtaining the current row of actual data, the exclusive-or restoring module 253 transmits the current row of actual data to the second data buffer memory 22*b* through the fourth collecting module 252 for buffering; the actual data transmitting module 254 is connected to the exclusive-or restoring module 253, for transmitting the current row of actual data obtained by the exclusive-or restoring module 253. The manner of exclusive-or operation adopted by the exclusive-or restoring module 253 can be referred to the embodiment shown in Table 3, and we will not go further on this issue.

Figure 7:
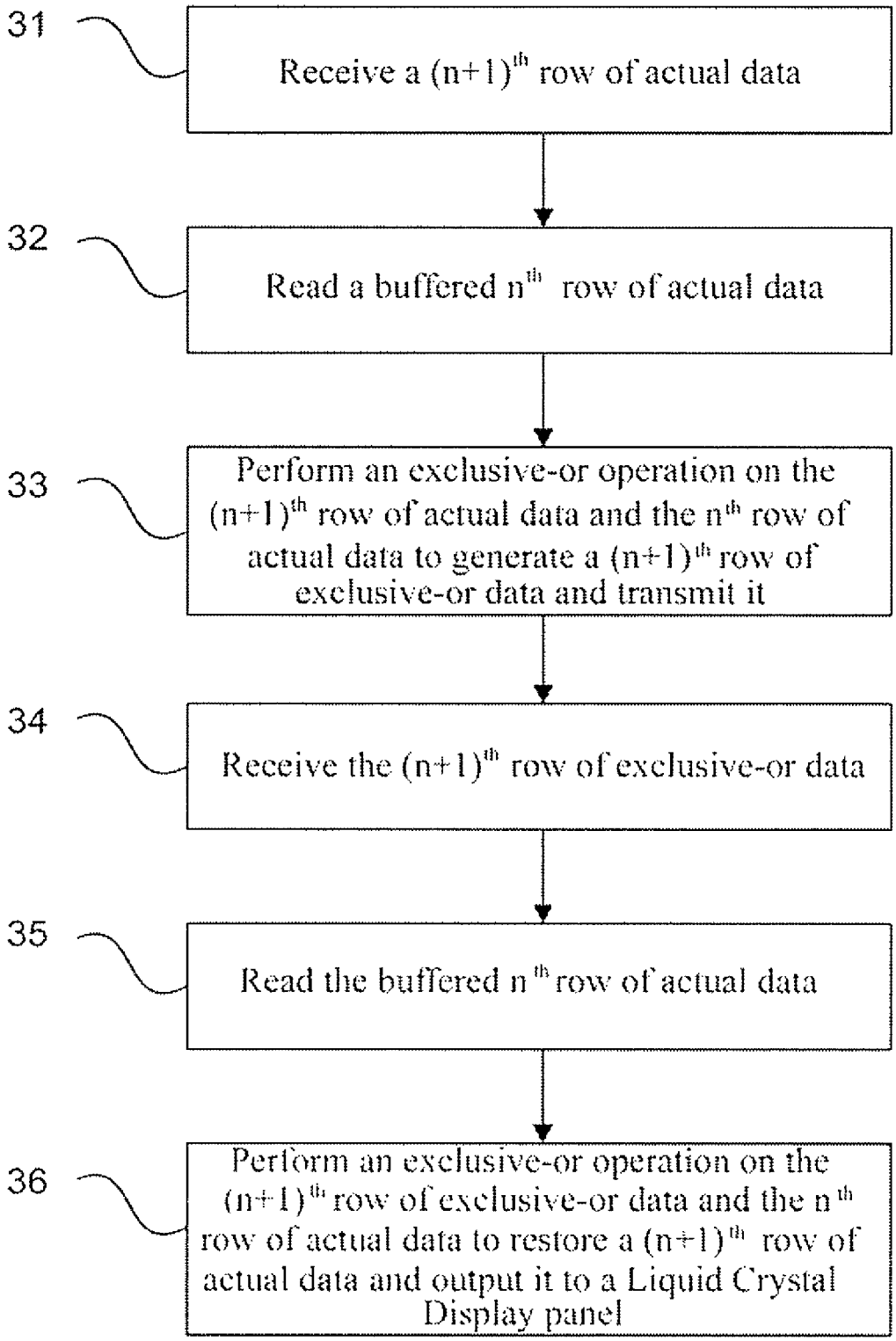
FIG. 7 is a flow diagram of a third scheme of the Liquid Crystal Display data processing method of the present invention.

FIG. 7 is a flow diagram of a third scheme of the Liquid Crystal Display data processing method of the present invention, and the third scheme particularly is:

step 31 of receiving a $(n+1)^{th}$ row of actual data;

step 32 of reading a buffered $n^{th}$ row of actual data;

step 33 of performing an exclusive-or operation on the $(n+1)^{th}$ row of actual data and the $n^{th}$ row of actual data to generate a $(n+1)^{th}$ row of exclusive-or data and transmit it;

step 34 of receiving the $(n+1)^{th}$ row of exclusive-or data;

step 35 of reading the buffered $n^{th}$ row of actual data; and step 36 of performing an exclusive-or operation on the $(n+1)^{th}$ row of exclusive-or data and the $n^{th}$ row of actual data to restore a $(n+1)^{th}$ row of actual data and output it to a Liquid Crystal Display panel.

The present scheme is a combination scheme of the first scheme of the Liquid Crystal Display data processing method of the present invention as shown in FIG. 1 and the second scheme of the Liquid Crystal Display data processing method of the present invention as shown in FIG. 4, the content of which has been introduced in details above, and we will not go further on this issue.

Figure 8:
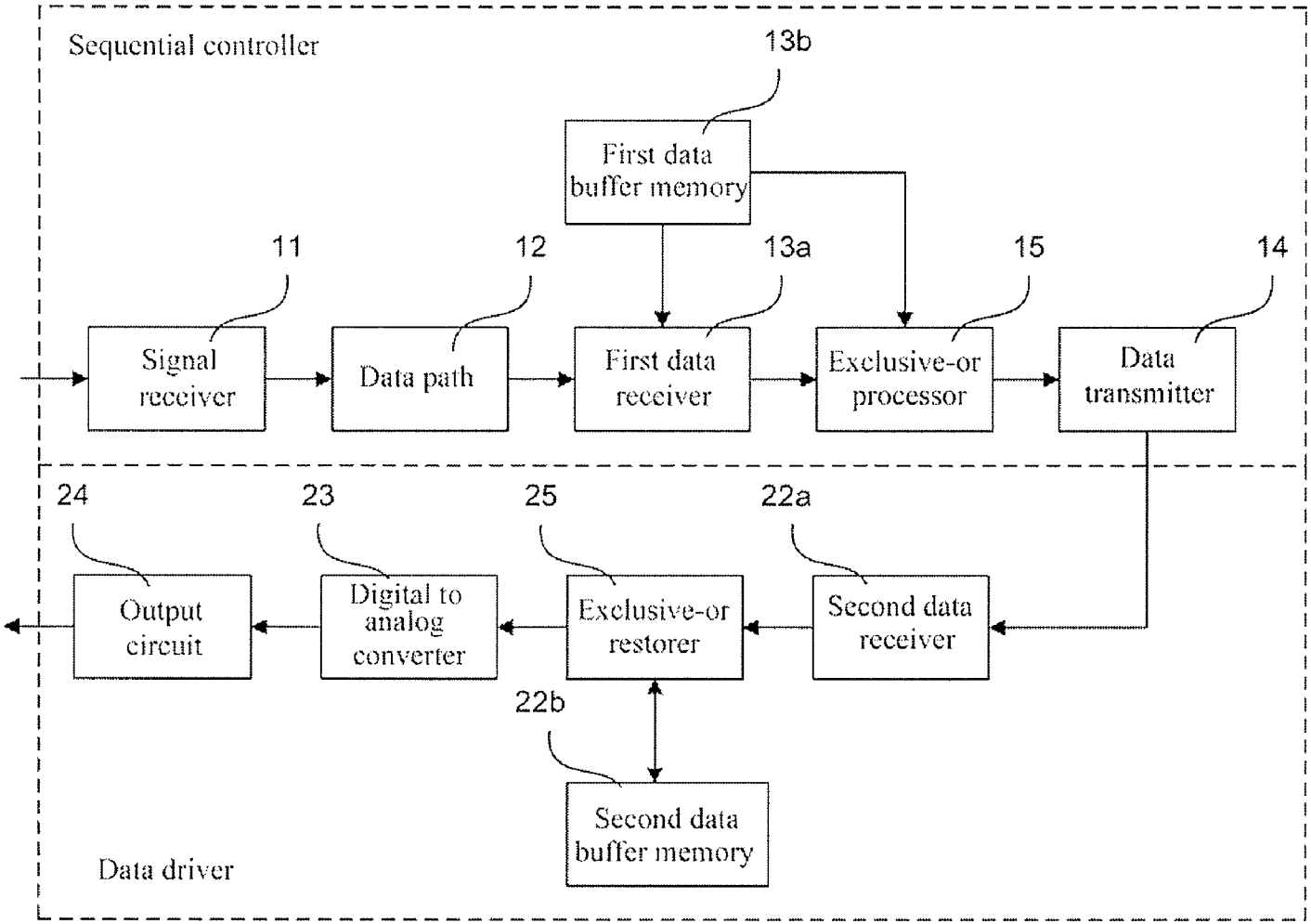
FIG. 8 is a structural diagram of a third scheme of the Liquid Crystal Display data processing apparatus of the present invention.
Figure 9:
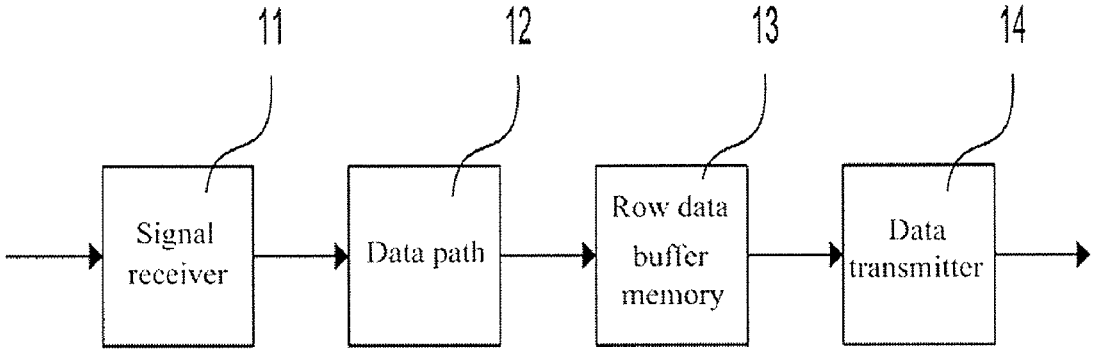
FIG. 9 is a structural schematic diagram of a sequential controller of prior art.
Figure 10:
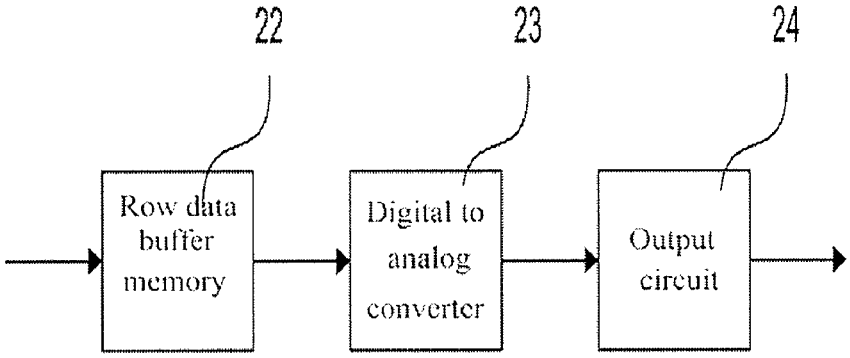
FIG. 10 is a structural schematic diagram of a data driver of prior art.

FIG. 8 is a structural diagram of the third scheme of the Liquid Crystal Display data processing apparatus of the present invention, which is an implementation apparatus adopting the third scheme of the Liquid Crystal Display data processing method of the present invention shown in FIG. 7. The data processing apparatus of the present scheme comprises a sequential controller and a data driver, wherein the sequential controller comprises signal receiver 11, data path 12, first data receiver 13*a*, first data buffer memory 13*b*, data transmitter 14, and exclusive-or processor 15, and the data driver comprises second data receiver 22*a*, second data buffer memory 22*b*, digital to analog converter 23, output circuit 24, and exclusive-or restorer 25. The present scheme is in fact a combination scheme of the first scheme of the Liquid Crystal Display data processing apparatus of the present invention as shown in FIG. 2 and FIG. 3 and the second scheme of the Liquid Crystal Display data processing apparatus of the present invention as shown in FIG. 5 and FIG. 6; contents of the sequential controller and the data driver has been introduced in details above, and we will not go further on this issue.

Finally, it should be explained that the embodiments above are only used to explain the technical solution of the present invention but not limit; although the present invention has been explained in details with reference to the preferred embodiments, it is understood by those of ordinary skills in the art that modifications or equivalent replacements can be made to the technical solution of the present invention, without departing from spirits and scopes of the technical solution of the present invention.

The invention claimed is:

1. A Liquid Crystal Display data processing method, comprising:

step 1 of receiving a current row of actual data;

step 2 of reading a buffered previous row of actual data; and step 3 of performing an exclusive-or operation on the current row of actual data and the previous row of actual data to generate a current row of exclusive-or data and transmit it to a data driver, wherein the step 3 particularly is: performing the exclusive-or operation on the current row of actual data and the previous row of actual data, letting an exclusive-or result of a $m^{th}$ term in the current row of exclusive-or data be 0 when the data of a $m^{th}$ term in the current row of actual data and the data of a $m^{th}$ term in the previous row of actual data is identical, letting an exclusive-or result of the $m^{th}$ term in the current row of exclusive-or data be 1 when the data of the $m^{th}$ term in the current row of actual data and the data of the $m^{th}$ term in the previous row of actual data is not identical, and generating the current row of exclusive-or data and transmitting it to the data driver, wherein m=1~M, n=1~N, M is the number of bits in each row of sub-pixels display data of a Liquid Crystal Display panel, and N is the number of rows of the sub-pixels of the Liquid Crystal Display panel.

2. The Liquid Crystal Display data processing method according to claim 1, further comprising:

step 4 of receiving the current row of exclusive-or data;

step 5 of reading the buffered previous row of actual data; and step 6 of performing an exclusive-or operation for the current row of exclusive-or data and the previous row of actual data to restore a current row of actual data and output it to a Liquid Crystal Display panel.

3. The Liquid Crystal Display data processing method according to claim 2, wherein the step 3 particularly is: performing the exclusive-or operation on the current row of actual data and the previous row of actual data, letting an exclusive-or result of a $m^{th}$ term in the current row of exclusive-or data be 0 when the data of a $m^{th}$ term in the current row of actual data and the data of a $m^{th}$ term in the previous row of actual data is identical, letting an exclusive-or result of the $m^{th}$ term in the current row of exclusive-or data be 1 when the data of the $m^{th}$ term in the current row of actual data and the data of the $m^{th}$ term in the previous row of actual data is not identical, and generating the current row of exclusive-or data and transmitting it to the data driver, wherein m=1~M, n=1~N, M is the number of bits in each row of sub-pixels display data of a Liquid, Crystal Display panel, and N is the number of rows of the sub-pixels of the Liquid Crystal Display panel.

4. The Liquid Crystal Display data processing method according to claim 2, wherein the step 3 particularly is: performing the exclusive-or operation on the current row of actual data and the previous row of actual data, letting an exclusive-or result of a $m^{th}$ term in the current row of exclusive-or data be 1 when the data of a $m^{th}$ term in the current row of actual data and the data of a $m^{th}$ term in the previous row of actual data is identical, letting an exclusive-or result of the $m^{th}$ term in the current row of exclusive-or data be 0 when the data of the $m^{th}$ term in the current row of actual data and the data of the $M^{th}$ term in the previous row of actual data is not identical, and generating the current row of exclusive-or data and transmitting it to the data driver, wherein m=1~M, n=1~N, M is the number of bits in each row of sub-pixels display data of a Liquid Crystal Display panel, and N is the number of rows of the sub-pixels of the Liquid Crystal Display panel.

5. The Liquid Crystal Display data processing method according to claim 2, wherein the step 3 particularly is: performing the exclusive-or operation on the current row of actual data and the previous row of actual data, letting an exclusive-or result of a $m^{th}$ term in the current row of exclusive-or data be 0 when the data of a $m^{th}$ term in the current row of actual data and the data of a $m^{th}$ term in the previous row of actual data is identical, letting an exclusive-or result of the $m^{th}$ term in the current row of exclusive-or data be 1 when the data of the $m^{th}$ term in the current row of actual data and the data of the $m^{th}$ term in the previous row of actual data is not identical, and generating the current row of exclusive-or data and transmitting it to the data driver, wherein m=1~M, n=1~N, M is the number of bits in each row of sub-pixels display data of a Liquid Crystal Display panel, and N is the number of rows of the sub-pixels of the Liquid Crystal Display panel;

the step 6 particularly is: performing the exclusive-or operation on the current row of exclusive-or data and the previous row of actual data, letting data of a $m^{th}$ term in the current row of actual data be equal to data of a $m^{th}$ term in the previous row of actual data when the $m^{th}$ term in the current row of exclusive-or data is 0, letting the data of the $m^{th}$ term in the current row of actual data be equal to an absolute value of the data of the $m^{th}$ term in the previous row of actual data minus 1 when the $m^{th}$ term in the current row of exclusive-or data is 1, and restoring the current row of actual data and outputting it to the Liquid Crystal Display panel, wherein m=1~M, n=1~N, M is the number of bits in each row of sub-pixels display data of a Liquid Crystal Display panel, and N is the number of rows of the sub-pixels of the Liquid Crystal Display panel.

6. The Liquid Crystal Display data processing method according to claim 2, wherein the step 3 particularly is: performing the exclusive-or operation on the current row of actual data and the previous row of actual data, letting an exclusive-or result of a $m^{th}$ term in the current row of exclusive-or data be 1 when the data of a re term in the current row of actual data and the data of a $m^{th}$ term in the previous row of actual data is identical, letting an exclusive-or result of the $m^{th}$ term in the current row of exclusive-or data be 0 when the data of the $m^{th}$ term in the current row of actual data and the data of the $m^{th}$ term in the previous row of actual data is not identical, and generating the current row of exclusive-or data and transmitting it to the data driver, wherein m=1~M, n=1~N, M is the number of bits in each row of sub-pixels display data of a Liquid Crystal Display panel, and N is the number of rows of the sub-pixels of the Liquid Crystal Display panel;

the step 6 particularly is: performing the exclusive-or operation on the current row of exclusive-or data and the previous row of actual data, letting data of a $m^{th}$ term in the current row of actual data be equal to data of a $m^{th}$ term in the previous row of actual data when the $m^{th}$ term in the current row of exclusive-or data is 1, letting the data of the $m^{th}$ term in the current row of actual data be equal to an absolute value of the data of the $m^{th}$ term in the previous row of actual data minus 1 when the $m^{th}$ term in the current row of exclusive-or data is 0, and restoring the current row of actual data and outputting it to the Liquid Crystal Display panel, wherein m=1~M, n=1~N, M is the number of bits in each row of sub-pixels display data of a Liquid Crystal Display panel, and N is the number of rows of the sub-pixels of the Liquid Crystal Display panel.

7. The Liquid Crystal Display data processing method according to claim 1, wherein the step 3 particularly is: performing the exclusive-or operation on the current row of actual data and the previous row of actual data, letting an exclusive-or result of a $m^{th}$ term in the current row of exclusive-or data be 1 when the data of a $m^{th}$ term in the current row of actual data and the data of a $m^{th}$ term in the previous row of actual data is identical, letting an exclusive-or result of the $m^{th}$ term in the current row of exclusive-or data be 0 when the data of the $m^{th}$ term in the current row of actual data and the data of the $m^{th}$ term in the previous row of actual data is not identical, and generating the current row of exclusive-or data and transmitting it to the data driver, wherein m=1~M, n=1~N, M is the number of bits in each row of sub-pixels display data of a Liquid Crystal Display panel, and N is the number of rows of the sub-pixels of the Liquid Crystal Display panel.

8. A Liquid Crystal Display data processing apparatus, comprising:

a signal receiver for receiving input signals transmitted by an external device;

a data path connected to the signal receiver, for combining the input signals to form one aligned row of data;

a first data receiver connected to the data path, for receiving a current row of actual data transmitted by the data path at a current time;

a first data buffer memory for buffering a previous row of actual data;

an exclusive-or processor connected to the first data receiver and the first data buffer memory respectively, for performing an exclusive-or operation on the current row of actual data and the previous row of actual data to generate a current row of exclusive-or data;

a data transmitter connected to the exclusive-or processor, for transmitting the current row of exclusive-or data to the data driver;

a second data receiver connected to the data transmitter, for receiving a current row of exclusive-or data from the sequential controller;

a second data buffer memory, for buffering a previous row of actual data;

an exclusive-or restorer connected to the second data receiver and the second data buffer memory respectively, for performing an exclusive-or operation on the current row of exclusive-or data and the previous row of actual data to restore a current row of actual data;

a digital to analog converter connected to the exclusive-or restorer, for performing a digital to analog conversion on the current row of actual data; and an output circuit connected to the digital to analog converter, for outputting the current row of actual data to a Liquid Crystal Display panel.

9. The Liquid Crystal Display data processing apparatus according to claim 8, wherein the exclusive-or processor comprises:

a first collecting module connected to the first data receiver, for collecting the current row of actual data;

a second collecting module connected to the first data buffer memory, for collecting the previous row of actual data;

an exclusive-or processing module connected to the first collecting module and the second collecting module respectively, for performing an operation on the current row of actual data and the previous row of actual data in manner of exclusive-or operation to obtain the current row of exclusive-or data composed by exclusive-or results, wherein an exclusive-or result of an item in the current row of exclusive-or data is 0 when data of corresponding terms in the current row of actual data and the previous row of actual data is identical, and the exclusive-or result of the item in the current row of exclusive-or data is 1 when data of corresponding terms in the current row of actual data and the previous row of actual data is not identical; and an exclusive-or data transmitting module connected to the exclusive-or processing module, for transmitting the current row of exclusive-or data.

10. The Liquid Crystal Display data processing apparatus according to claim 8, wherein the exclusive-or processor comprises:

a first collecting module connected to the first data receiver, for collecting the current row of actual data;

a second collecting module connected to the first data buffer memory, for collecting the previous row of actual data;

an exclusive-or processing module connected to the first collecting module and the second collecting module respectively, for performing an operation on the current row of actual data and the previous row of actual data in manner of exclusive-or operation to obtain the current row of exclusive-or data composed by exclusive-or results, wherein an exclusive-or result of an item in the current row of exclusive-or data is 0 when data of corresponding terms in the current row of actual data and the previous row of actual data is identical, and the exclusive-or result of the item in the current row of exclusive-or data is 1 when data of corresponding terms in the current row of actual data and the previous row of actual data is not identical; and an exclusive-or data transmitting module connected to the exclusive-or processing module, for transmitting the current row of exclusive-or data.

11. The Liquid Crystal Display data processing apparatus according to claim 8, wherein the exclusive-or processor comprises:

a first collecting module connected to the first data receiver, for collecting the current row of actual data;

a second collecting module connected to the first data buffer memory, for collecting the previous row of actual data;

an exclusive-or processing module connected to the first collecting module and the second collecting module respectively, for performing an operation on the current row of actual data and the previous row of actual data in manner of exclusive-or operation to obtain the current row of exclusive-or data composed by exclusive-or results, wherein an exclusive-or result of an item in the current row of exclusive-or data is 1 when data of corresponding terms in the current row of actual data and the previous row of actual data is identical, and the exclusive-or result of the item in the current row of exclusive-or data is 0 when data of corresponding terms in the current row of actual data and the previous row of actual data is not identical; and an exclusive-or data transmitting module connected to the exclusive-or processing module, for transmitting the current row of exclusive-or data.

12. The Liquid Crystal Display data processing apparatus according to claim 8, wherein the exclusive-or restorer comprises:

a third collecting module connected to the second data receiver, for collecting the current row of exclusive-or data;

a fourth collecting module connected to the second data buffer memory, for collecting the previous row of actual data;

an exclusive-or restoring module connected to the third collecting module and the fourth collecting module respectively, for performing the exclusive-or operation on the current row of exclusive-or data and the previous row of actual data to restore the current row of actual data, wherein letting data of a certain term in the current row of actual data be equal to data of the certain term in the previous row of actual data when the certain term in current row of exclusive-or data is 0, and letting the data of the certain term in the current row of actual data be equal to an absolute value of the data of the certain term in the previous row of actual data minus 1 when the certain term in current row of exclusive-or data is 1; and an actual data transmitting module connected to the exclusive-or restoring module, for transmitting the current row of actual data.

13. The Liquid Crystal Display data processing apparatus according to claim 8, wherein the exclusive-or restorer comprises:

a third collecting module connected to the second data receiver, for collecting the current row of exclusive-or data;

a fourth collecting module connected to the second data buffer memory, for collecting the previous row of actual data;

an exclusive-or restoring module connected to the third collecting module and the fourth collecting module respectively, for performing the exclusive-or operation on the current row of exclusive-or data and the previous row of actual data to restore the current row of actual data, wherein letting data of a certain term in the current row of actual data be equal to data of the certain term in the previous row of actual data when the certain term in current row of exclusive-or data is 1, and letting the data of the certain term in the current row of actual data be equal to an absolute value of the data of the certain term in the previous row of actual data minus 1 when the certain term in current row of exclusive-or data is 0; and an actual data transmitting module connected to the exclusive-or restoring module, for transmitting the current row of actual data.

14. A Liquid Crystal Display data processing method, comprising:

step 1 of receiving a current row of exclusive-or data from a sequential controller;

step 2 of reading a buffered previous row of actual data; and step 3 of performing an exclusive-or operation on the current row of exclusive-or data and the previous row of actual data to restore a current row of actual data and output it to a Liquid Crystal Display panel, wherein the step 3 particularly is: performing the exclusive-or operation on the current row of exclusive-or data and the previous row of actual data, letting data of a $m^{th}$ term in the current row of actual data be equal to data of a $m^{th}$ term in the previous row of actual data when the $m^{th}$ term in the current row of exclusive-or data is 0, letting the data of the $m^{th}$ term in the current row of actual data be equal to an absolute value of the data of the $m^{th}$ term in the previous row of actual data minus 1 when the $m^{th}$ term in the current row of exclusive-or data is 1, and restoring the current row of actual data and outputting it to the Liquid Crystal Display panel, wherein m=1~M, n=1~N, M is the number of bits in each row of sub-pixels display data of a Liquid Crystal Display panel, and N is the number of rows of the sub-pixels of the Liquid Crystal Display panel.

15. A Liquid Crystal Display data processing method, comprising:

step 1 of receiving a current row of exclusive-or data from a sequential controller;

step 2 of reading a buffered previous row of actual data: and step 3 of performing an exclusive-or operation on the current row of exclusive-or data and the previous row of actual data to restore a current row of actual data and output it to a Liquid Crystal Display panel, wherein the step 3 particularly is: performing the exclusive-or operation on the current row of exclusive-or data and the previous row of actual data, letting data of a $m^{th}$ term in the current row of actual data be equal to data of $m^{th}$ term in the previous row of actual data when the $m^{th}$ term in the current row of exclusive-or data is 1, letting the data of the $m^{th}$ term in the current row of actual data be equal to an absolute value of the data of the $m^{th}$ term in the previous row of actual data minus 1 when the $m^{th}$ term in the current row of exclusive-or data is 0, and restoring the current row of actual data and outputting it to the Liquid Crystal Display panel, wherein m=1~M, n=1~N, M is the number of bits in each row of sub-pixels display data of a Liquid Crystal Display panel, and N is the number of rows of the sub-pixels of the Liquid Crystal Display panel.

16. A Liquid Crystal Display data processing apparatus, comprising:

a second data receiver connected to a sequential controller, for receiving a current row of exclusive-or data from the sequential controller;

a second data buffer memory, for buffering a previous row of actual data;

an exclusive-or restorer connected to the second data receiver and the second data buffer memory respectively, for performing an exclusive-or operation on the current row of exclusive-or data and the previous row of actual data to restore a current row of actual data;

a digital to analog converter connected to the exclusive-or restorer, for performing a digital to analog conversion on the current row of actual data; and an output circuit connected to the digital to analog converter, for outputting the current row of actual data to a Liquid Crystal Display panel, wherein the exclusive-or restorer comprises:

a third collecting module connected to the second data receiver, for collecting the current row of exclusive-or data;

a fourth collecting module connected to the second data buffer memory, for collecting the previous row of actual data;

an exclusive-or restoring module connected to the third collecting module and the fourth collecting module respectively, for performing the exclusive-or operation on the current row of exclusive-or data and the previous row of actual data to restore the current row of actual data, wherein letting data of a certain term in the current row of actual data be equal to data of the certain term in the previous row of actual data when the certain term in current row of exclusive-or data is 0, and letting the data of the certain term in the current row of actual data be equal to an absolute value of the data of the certain term in the previous row of actual data minus 1 when the certain term in current row of exclusive-or data is 1; and an actual data transmitting module connected to the exclusive-or restoring module, for transmitting the current row of actual data.

* * * * *